United States Patent [19]

Menchetti et al.

[11] Patent Number: 4,628,656

[45] Date of Patent: Dec. 16, 1986

[54] DEMOUNTABLE WALL PANEL

[75] Inventors: Robert J. Menchetti, North Olmsted; Robert H. Safran, Sheffield; Gale E. Sauer, North Olmsted, all of Ohio

[73] Assignee: Donn Incorporated, Westlake, Ohio

[21] Appl. No.: 725,941

[22] Filed: Apr. 22, 1985

[51] Int. Cl.[4] ..... E04B 2/56

[52] U.S. Cl. ..... 52/481; 52/489; 52/762

[58] Field of Search ..... 52/762, 489, 481

[56] References Cited

U.S. PATENT DOCUMENTS

| | | | |
|---|---|---|---|
| 2,277,792 | 3/1942 | Small | 52/762 |
| 2,841,255 | 7/1958 | Kemp | 52/489 |
| 3,216,166 | 11/1965 | Brown | 52/511 |
| 3,429,090 | 2/1969 | Metelnick | 52/481 |
| 3,548,557 | 12/1970 | Downing, Jr. | 52/762 |
| 3,623,290 | 11/1971 | Downing, Jr. | 52/481 |
| 3,934,387 | 1/1976 | Moeller | 52/760 |
| 4,018,020 | 4/1977 | Sauer et al. | 52/481 |
| 4,069,640 | 1/1978 | Dawdy | 52/481 |
| 4,231,205 | 11/1980 | Wendt | 52/481 |
| 4,546,584 | 10/1985 | Mieyal et al. | 52/481 |

FOREIGN PATENT DOCUMENTS

| | | | |
|---|---|---|---|
| 1034733 | 7/1978 | Canada | 52/489 |
| 433661 | 4/1967 | Switzerland | 52/762 |
| 933787 | 8/1963 | United Kingdom | 52/762 |

OTHER PUBLICATIONS

Hauserman, *New Co-ordinator Double Wall*, 7/1963, p. 4.

*Primary Examiner*—John E. Murtagh
*Assistant Examiner*—Caroline Dennison
*Attorney, Agent, or Firm*—Pearne, Gordon, Sessions, McCoy, Granger & Tilberry

[57] ABSTRACT

A demountable wall system is disclosed in which panels are removably connected to H-shaped metal studs. The principal structure of the panel is provided by a wallboard having a width less than the modular spacing between studs. Sheet metal mounting strips are adhesively secured along the opposite edges of the wallboard and are positioned with respect to each other so as to provide the assembled panel with an exact modular width. Each mounting clip includes a connector portion which releasably secures the panels to the studs and a finish portion which extends along but is spaced from the side edges of the wallboard. A facing sheet of flexible sheet material is laminated to the forward face of the wallboard and extends across the gap between the finish portion of the mounting clips and the wallboard to hide such gap. The facing sheet then extends back along the finish portion and is provided with an edge positioned where it is not likely to be loosened during the handling and assembly of the panels.

9 Claims, 3 Drawing Figures

DEMOUNTABLE WALL PANEL

BACKGROUND OF THE INVENTION

This invention relates generally to demountable wall structures, and more particularly to a novel and improved panel structure for such walls.

PRIOR ART

Demountable walls often provide H-shaped sheet metal studs with wall panels removably mounted thereon. The panels are often formed of sheet metal, with a gypsum board backing laminated to the central portion of the sheet metal. In such panels, the side edges of the metal sheets have been shaped to releasably interlock with the studs. U.S. Pat. Nos. 3,548,557; 3,623,290; and 4,231,205 each disclose examples of such systems.

In such systems, the modular width of the panel is determined by the spacing between the shaped side edges of the metal sheet and the width of the gypsum board is less than the modular width. In fact, the width of the gypsum board can vary substantially without producing problems, since the spacing between the shaped edges of the metal is determined by the metal itself and not by the width of the gypsum board.

It is also known to provide panels with clips which fit on opposite sides of the panel and provide a panel mounting system. Examples of such panel structures are illustrated in U.S. Pat. Nos. 3,216,166; 3,429,090; and 3,934,387. Such patents, however, do not illustrate systems for maintaining the modular size of the panel without requiring that the wallboard dimensions be accurately maintained.

SUMMARY OF THE INVENTION

The present invention provides a novel and improved panel structure for demountable walls. With such invention, a full metal face is not required and the modular size of the panel is maintained without requiring that the wallboard dimensions be accurately maintained.

In the illustrated embodiment, the panel provides a wallboard, such as gypsum board, with mounting strips secured to the opposite edges of the board. These strips, which are sheet metal in the illustrated embodiment, perform three separate functions: they provide a mounting structure for releasably securing the panels to the studs; they provide a sizing function to accurately establish the modular size of the panel and compensate for variations in the size of the wallboard; and they provide the edge dress or finish of the panel by including a smoothly curved intersection between the face and edge of the panel. In the illustrated embodiment, a facing sheet is laminated over the face of the gypsum board, around the forward end of the mounting strip, and back therealong so that a neat joint is provided between adjacent panels in an assembled wall.

These and other aspects of the present invention are illustrated in the accompanying drawings and more fully described in the following specification.

DETAILED DESCRIPTION OF THE DRAWINGS

Figure 1:
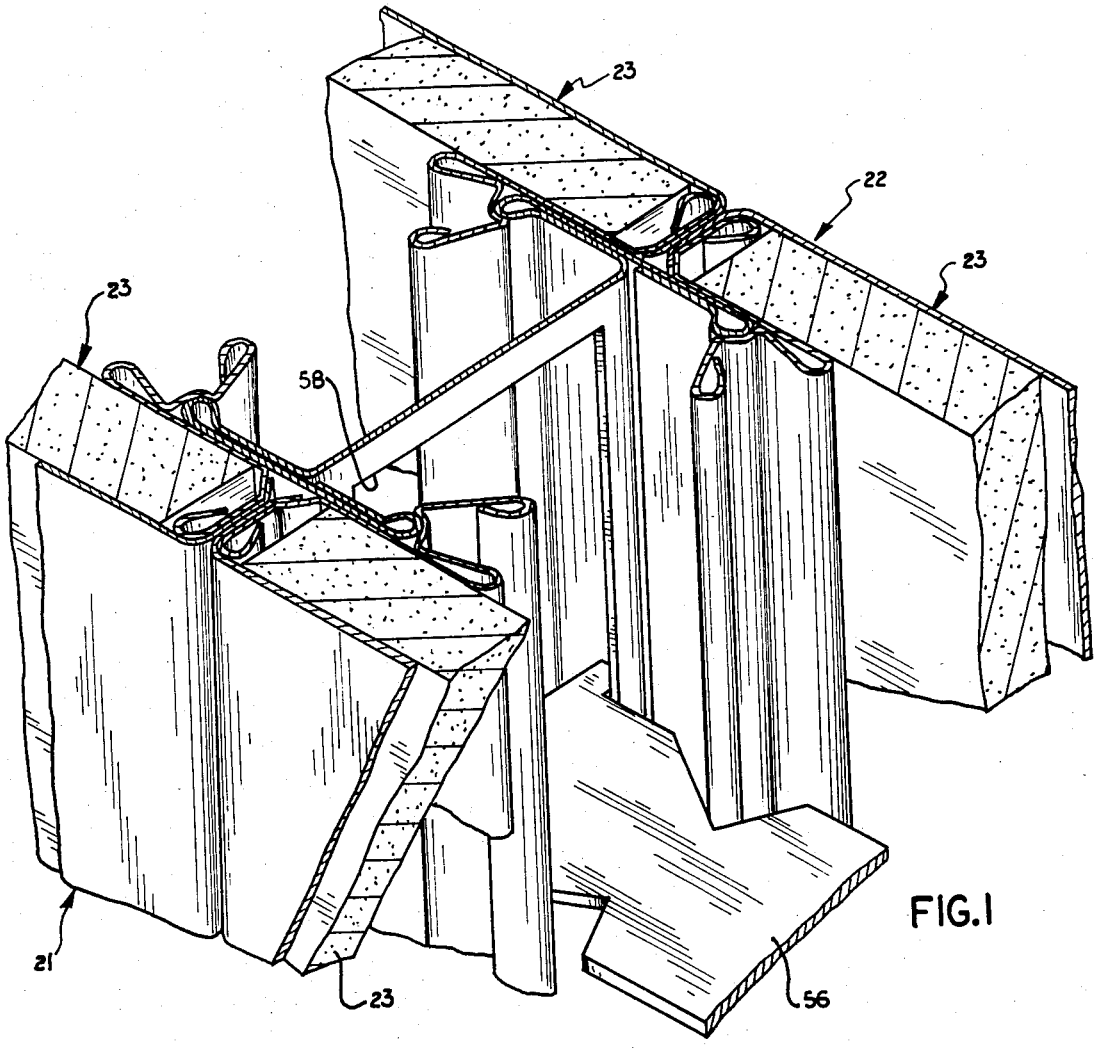
FIG. 1 is a fragmentary, perspective view illustrating the structure of a demountable wall system in accordance with this invention illustrating the mounting thereof on an H-shaped metal stud.

The present invention is particularly suited for use in demountable wall systems in which the panels are prefinished and in which the joints between the panels are in their finished condition as soon as the panels are installed. Consequently, the system of the type to which this invention is particularly suited does not require any subsequent joint finishing operation.

In an installed demountable wall in which the joints are not subsequently finished, it is important that the lateral dimensions or width of the panels be maintained with extreme accuracy to ensure that even in a relatively long wall having a relatively larger number of panels uniform closed joints will be provided.

When metal-faced panels of the type illustrated in the first three United States Letters Patent listed above are manufactured, the width of the panel is accurately maintained by the tooling used to form the rearwardly extending locking structure along the opposite sides of the panel. Further, in most cases, the metal facing is laminated to a backing board such as gypsum board to maintain the face of the metal flat and stable. However, the dimensional accuracies required for the backing board in most cases are not critical since a space exists between the lock system and the board, and variations in board width appear as variations in such space.

In some instances, demountable walls have been formed of wallboard such as gypsum board which is covered with a decorative material, often formed of vinyl sheeting or the like. In such instances, it is necessary to very accurately size the wallboard so that the various panels used in the system are identical in width. The production of accurately sized wallboard is expensive and often requires custom sizing, which even further increases the manufacturing costs. The present invention permits the low cost manufacture of an accurately sized panel.

Referring to the drawings, a demountable wall incorporating the present invention includes a plurality of vertically extending spaced and parallel studs 10. The particular stud illustrated is H-shaped and is formed of sheet metal. Such stud includes a central web 11 and oppositely extending flanges 12 and 13 along the edges of the web 11. The flanges 12 and 13 are identical and are each formed by bending the metal so as to produce a first leg 14 extending from the web 11 to a reverse bend at 16. From such bend, the metal extends along an outer face leg 17 to a second bend 18, and then back, providing a third leg 19 extending along the rearward face of the outer face leg 17 to an end substantially adjacent to the web 11. The reverse bends 16 and 18 are preferably formed with a relatively full radius so as to provide a smooth, curved margin along each edge of the associated flange.

The spaced rows 21 and 22 of panels 23 are removably mounted along the faces of the flanges 12 and 13 and cooperate to provide an exterior wall surface on each side of the studs.

In the illustrated embodiment, the wallboard 24, which provides the principal panel structure, is gypsum board. However, the panels can be formed of other materials, such as chipboard, plywood, and the like, and the term "wallboard" as used herein is not limited to gypsum board.

Figure 3:
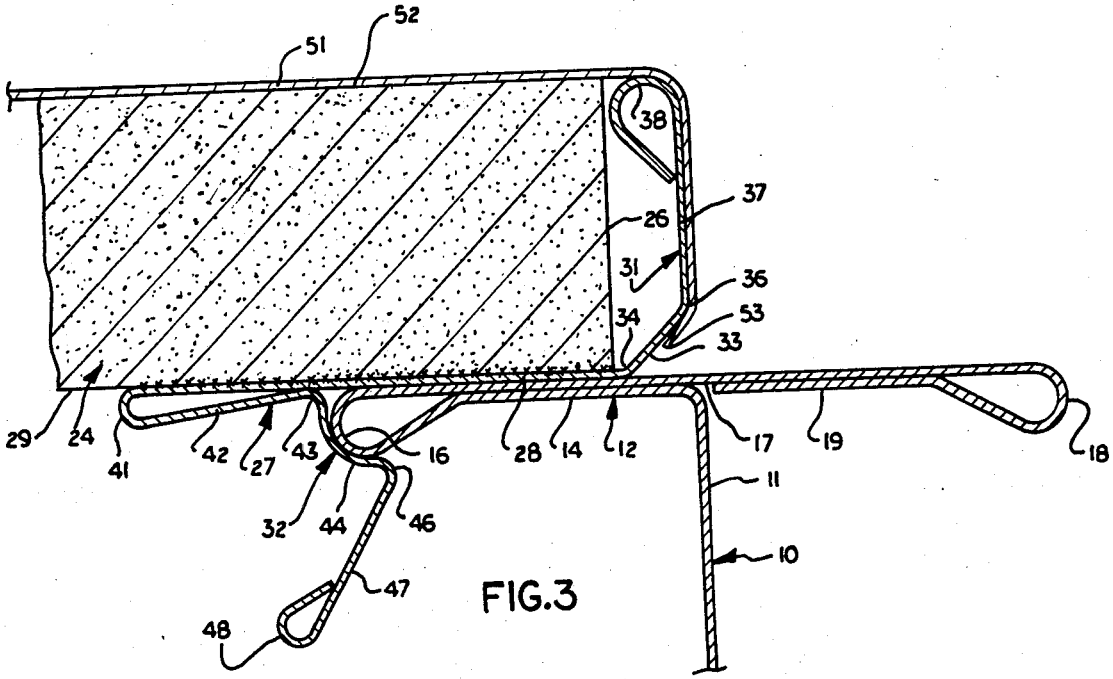
FIG. 3 is a fragmentary, enlarged view, illustrating the mounting of one of the panel edges on a metal stud.

Mounted along each side edge 26 of the wallboard is a mounting strip 27, preferably formed of sheet metal, bent to a shape best illustrated in FIG. 3. Each mounting strip includes a flat, central portion 28 secured along the back face 29 of the wallboard 24 substantially adjacent to the side edge 26. Normally, the central portion is mounted with a suitable adhesive; however, other mounting means may be employed. Extending from one edge of the central portion is a finish portion 31 and along the opposite edge of the central portion the strip provides a connector portion 32.

The finish portion provides an inclined or diagonal wall 33 extending forwardly of the panel and diverging from the side edge from a first bend 34 to a second bend 36. From the second bend 36, the metal of the finish portion extends along a leg 37 substantially perpendicular to the back face 29 to an open, smoothly radiused, reverse bend 38.

The connector portion 32 functions as a spring clip to releasably connect the panel and the stud. Such connector portion is joined to the opposite end of the central portion 28 by a reverse bend 41 and provides a leg 42 extending from the bend 41 to a second bend 43. From the bend 43, the connector portion provides an arcuate portion 44 proportioned to fit the adjacent reverse bend 16 and produce a force urging the central portion 28 into contact with the outer face leg 17. From the arcuate portion 44, another bend 46 is provided which joins the arcuate portion 44 to an inclined camming leg 47. A hem 48 is provided at the outer end of the camming portion 47.

A facing sheet 51, such as a sheet of vinyl or the like, extends along the outer face 52 of the wallboard 24, around the curved end provided by the reverse bend 28, back along the legs 37, and terminates at an edge 53 approximately midway along the inclined or diagonal wall 33. Normally, the facing sheet is secured in position by adhesive (not illustrated). The reverse bend 38 is formed so that an extension of the plane of the outer face 52 tangentially intersects the forwardmost extremity of the outer surface of the reverse bend. Therefore, the facing sheet extends without interruption from the forward outer face 52 onto the finish portion 31 so that the existence of the gap between the finish portion and the outer surface is not externally visible when the panels are installed.

Further, the edge 53 is preferably provided along the inclined wall 33, where it does not come into contact with any other element of the system during the installation thereof. Therefore, the tendency for the edge 53 to come loose is minimized.

A spacer plate 56 extends between each of the adjacent studs 10 and maintains the exact modular spacing between the studs. The spacer plates 56 are installed in an opening 58 (illustrated in FIG. 1) in the stud web 11 and provide projections 57 which engage the remote sides of the web to prevent the associated studs from moving apart. Therefore, such spacer plates resist the tendency of the mounting system of the panel to cause the studs to move apart. The plates maintain the studs in a predetermined module spacing equal to the width of the panels established by the spacing between the surface portions 58 and 59 of the facing sheet as it extends along the leg 37. With such spacing, the adjacent panel edges fit together without any noticeable gap when the panels are installed.

Figure 2:
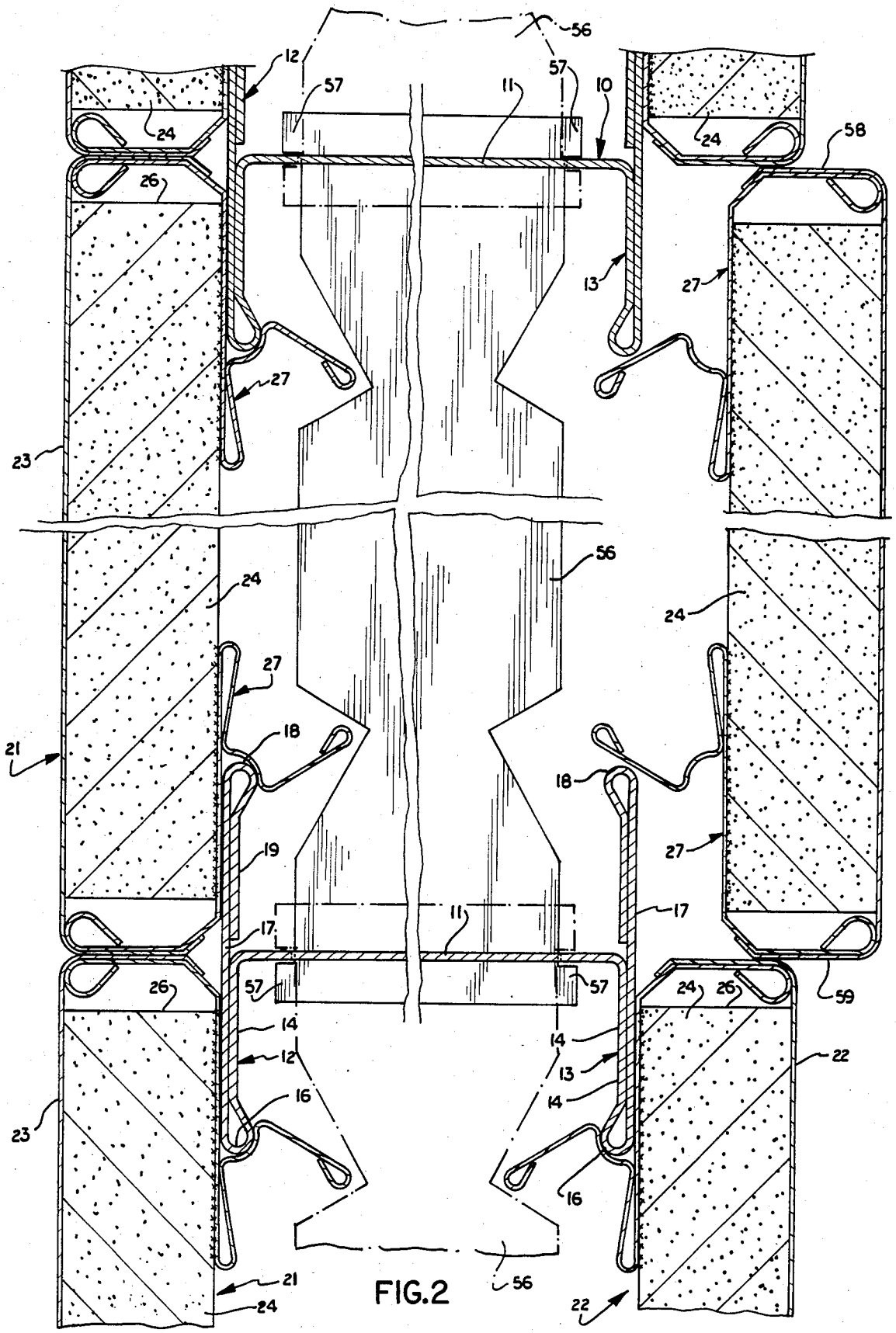
FIG. 2 is a broken, horizontal section through the wall illustrated in FIG. 1.

As best illustrated in FIG. 2, the mounting strips are sized and spaced so that the spacing between the hems 48 is less than the spacing between the adjacent bends 18 so that installation of the panels can be accomplished by merely pressing the panel inward against the stud flanges. Such action causes the connector portion to spring open until the mounted position is reached, at which time the connector portion snaps over the adjacent edges of the flanges to a mounted position illustrated in the left side of FIG. 2. Removal of the panels is accomplished by merely applying a force to the panel in a direction away from the studs. Here again, this causes the connector portions 32 to deform and allows removal of the panels. With this structure, panels can be installed and removed without adversely affecting the appearance or the structure of the panel.

The mounting of the mounting strips 27 on the wallboard 24 is such that the finish portion 31 is spaced from the adjacent side edge 26. Consequently, the width of the wallboard can vary, and the position of the mounting strips 27 on a given piece of wallboard is gaged so that the modular width of the panel is equal to the modular spacing between the studs. Variations in the wallboard width appear as variations in the spacing between the side edges 26 and the adjacent finish portion 31 of the mounting strips.

Because the mounting strips are formed of a flexible material, any small interference that might exist between adjacent panels merely causes a slight deflection in the finish portion 31. However, such interference should be minimal because the deflection of the finish portion can cause looseness in the facing sheet between the wallboard 24 and the finish portion of the mounting strip.

With the preferred structure in accordance with the present invention, it is not necessary to accurately size the wallboard, even though the finished panels are accurately dimensioned by the location of the mounting strips on the wallboard. Further, material costs of the present panel are substantially reduced when compared to panels having full metal facing. With this invention, demountable wall panels are provided which can be easily installed and removed without damage to the panels and which can be produced at lower costs.

Although the preferred embodiment of this invention has been shown and described, it should be understood that various modifications and rearrangements of the parts may be resorted to without departing from the scope of the invention as disclosed and claimed herein.

What is claimed is:

1. A demountable wall panel for installation on studs having a predetermined modular spacing comprising wallboards having widths less than said modular spacing by varying amounts, a pair of separate mounting strips individually mounted and directly secured to said wall boards along the side edges of said wallboards, said mounting strips providing connector portions operable to connect said panels to said studs and a finish portion extending along and spaced from the associated of said side edges of said wallboard, and a facing sheet laminated to said wallboard and along said finish portion, said facing sheet bridging the space between said side edges of said wallboard and the associated of said finish portion and operating to conceal the presence of said space, said finish portions of said mounting strips being spaced from said side edges an amount which compensates for variations in wallboard width and providing said panels with a width equal to said modular spacing.

2. A demountable wall panel as set forth in claim 1, wherein said mounting strips are formed with a planar mounting portion secured to the rearward face of said wallboard.

3. A demountable wall panel as set forth in claim 2, wherein said planar portion provides the only contact between said wallboard and said mounting strips.

4. A demountable wall panel as set forth in claim 3, wherein said finish portions are provided with a radiused portion having a forward extremity tangent with a plane of the forward face of said wallboard.

5. A demountable wall panel as set forth in claim 4, wherein said finish portions provide a diagonal portion adjacent the rearward face of said wall panel, and the edges of said facing sheet are secured to said diagonal portions, said edges of said facing sheets being spaced from adjacent the panels when said panels are installed on said studs.

6. A demountable wall system comprising a plurality of metal studs providing spaced and parallel flanges along opposite sides of said stud, said studs being mounted in spaced parallel vertical positions with a fixed predetermined modular spacing therebetween, a plurality of panels mounted at their side edges against said flanges in edge-abutting relationship, said panels each including a wallboard having a width approaching but less than said predetermined modular spacing, a pair of separate sheet metal mounting strips with one mounted on and directly secured to said wall board and extending along each of the edges of said wallboard providing a connecting portion releasably securing said panels to said studs, and a finish portion extending along and spaced from the associated of the side edge of said wallboard from the rear face to the forward face thereof, each of said mounting strips providing a planar portion extending along said rear face of said wallboard with the position of said planar portion of said strip along the opposite sides of said wallboard compensating for variations in said predetermined spacing and the width of said wallboard and positioning said finish portion on opposite sides of said panels at said predetermined spacing, and a facing sheet extending along said front face and said finish portion concealing the space therebetween.

7. A demountable wall system as set forth in claim 6, wherein spacers connect between adjacent studs to maintain said modular spacing therebetween.

8. A demountable wall system as set forth in claim 6, wherein said planar portions of said mounting strips provide substantially the only contact between said wallboard and said mounting strip.

9. A demountable wall system as set forth in claim 8, wherein said planar portions are adhesively secured to said wallboard.

* * * * *